US011801971B2

(12) United States Patent
Yen et al.

(10) Patent No.: US 11,801,971 B2
(45) Date of Patent: Oct. 31, 2023

(54) INTERLOCKING CONTAINERS

(71) Applicant: Omielife, Inc., San Francisco, CA (US)

(72) Inventors: Nancy Yen, San Francisco, CA (US); Maria Bujalska, San Francisco, CA (US); Aaron McCready, Truckee, CA (US)

(73) Assignee: Omielife, Inc., San Francisco, CA (US)

( * ) Notice: Subject to any disclaimer, the term of this patent is extended or adjusted under 35 U.S.C. 154(b) by 0 days.

(21) Appl. No.: 17/558,330

(22) Filed: Dec. 21, 2021

(65) Prior Publication Data

US 2022/0267050 A1 Aug. 25, 2022

Related U.S. Application Data

(60) Provisional application No. 63/153,788, filed on Feb. 25, 2021.

(51) Int. Cl.

*B65D 21/02* (2006.01)
*B65D 25/24* (2006.01)
*B65D 43/02* (2006.01)

(52) U.S. Cl.

CPC ..... *B65D 21/0223* (2013.01); *B65D 21/0233* (2013.01); *B65D 25/24* (2013.01); *B65D 43/0212* (2013.01); *B65D 2543/0075* (2013.01); *B65D 2543/00527* (2013.01); *B65D 2543/00537* (2013.01); *B65D 2543/00648* (2013.01); *B65D 2543/00685* (2013.01); *B65D 2543/00805* (2013.01); *B65D 2543/00962* (2013.01)

(58) Field of Classification Search

CPC ..... B65D 21/0223; B65D 21/0233; B65D 25/24; B65D 43/0212; B65D 2543/00527; B65D 2543/00537; B65D 2543/00648; B65D 2543/00685; B65D 2543/0075; B65D 2543/00805; B65D 2543/00962; B65D 2543/00185; B65D 2543/00564

USPC ..... 220/501

See application file for complete search history.

(56) References Cited

U.S. PATENT DOCUMENTS

| | | | | |
|---|---|---|---|---|
| 2,299,277 | A * | 10/1942 | Neuschaefer | A45D 34/00 206/509 |
| 3,999,818 | A * | 12/1976 | Schankler | B65D 21/0204 312/107 |
| 7,661,528 | B2 * | 2/2010 | Vovan | B65D 43/0231 206/508 |
| 9,108,766 | B2 * | 8/2015 | Gosen | B65D 21/0233 |
| 10,308,394 | B1 * | 6/2019 | Robl | B65D 21/0223 |
| 10,773,861 | B2 * | 9/2020 | Caswell | B65D 43/0202 |
| 10,858,155 | B1 * | 12/2020 | Caruso | B65D 21/0217 |

(Continued)

FOREIGN PATENT DOCUMENTS

| | | | | |
|---|---|---|---|---|
| KR | 101367192 B1 * | 3/2014 | | B65D 21/036 |
| KR | 20150108341 A * | 9/2015 | | B65D 43/0212 |

*Primary Examiner* — James N Smalley
*Assistant Examiner* — Eric C Baldrighi
(74) *Attorney, Agent, or Firm* — Loginov & Associates, PLLC; William A. Loginov

(57) ABSTRACT

A container system with an interlocking mechanism is disclosed. The containers of the system have interlocking components that securely interconnect the individual containers vertically, so that groupings of containers can be transported easily. The containers can be water tight and air tight. The container can be modular and form infinite combinations of stacked and interlocked groupings.

20 Claims, 26 Drawing Sheets

(56) References Cited

U.S. PATENT DOCUMENTS

| | | | | |
|---|---|---|---|---|
| 2013/0213846 | A1* | 8/2013 | Hendrickson | B65D 21/0216 206/509 |
| 2015/0232230 | A1* | 8/2015 | Kim | B65D 21/0204 206/504 |
| 2018/0220758 | A1* | 8/2018 | Burchia | B25H 3/02 |
| 2020/0247581 | A1* | 8/2020 | Hartley | B65D 21/0222 |
| 2020/0346819 | A1* | 11/2020 | Kögel | B25H 3/02 |
| 2023/0092514 | A1* | 3/2023 | Brocket | B65D 21/02 |

* cited by examiner

INTERLOCKING CONTAINERS

RELATED APPLICATION

This application claims the benefit of co-pending U.S. Provisional Application Ser. No. 63/153,788, entitled INTERLOCKING CONTAINERS, filed Feb. 25, 2021, the teachings of which are expressly incorporated herein by reference.

FIELD OF THE INVENTION

The present invention relates to storage container systems. Particularly to a storage system that includes a plurality of containers and lids, with the lids being capable of sealing the containers, and with the sealed containers being capable of stackably interlocking.

BACKGROUND OF THE INVENTION

There are many different types of storage containers, many of which can be stacked and nested in order to save space. Some systems even have a plurality of different sized containers which can be stacked or nested together to form a compact shape. However, most container systems do not provide a secure locking mechanism which can allow containers to engage and disengage freely on the X-axis, while remaining securely locked on the Y-axis. This problem is most obvious when users attempt to transport the stacked containers. Any upward pulling motion would cause the stacked shape to disengage.

SUMMARY OF THE INVENTION

The present application provides a container system comprising of one large container having an open top and a resealable lid, and one or more smaller containers with open tops and resealable lids. The containers of the system have interlocking components that securely interconnect the individual containers vertically, so that groupings of containers can be transported easily.

Each container in the container system has a bottom wall, a plurality of side walls attached to the bottom wall to form a volume, and an open top. The bottom wall has an outside surface and an inside surface. On the outside surface there is a plurality of extruded feet which form a recessed groove.

Each container in the container system has a resealable lid which is configured to close the top of each container. The lid also has an outside surface and an inside surface. On the outside surface of the lid there is a rail which extends above the surface.

The containers can be stackably interlocked by sliding the extruded feet on the bottom wall of one container over the rail on the lid of a sealed second container. The recessed groove of the feet have a geometry that is complementary to the rail so it slides easily for locking and separation.

The containers can form infinite combinations of stacked and interlocked groupings, for example, two large containers, one large container and two small containers, three small containers, and so on.

BRIEF DESCRIPTION OF THE DRAWINGS

The invention description below refers to the accompanying drawings, of which.

DETAILED DESCRIPTION

Figure 1A:
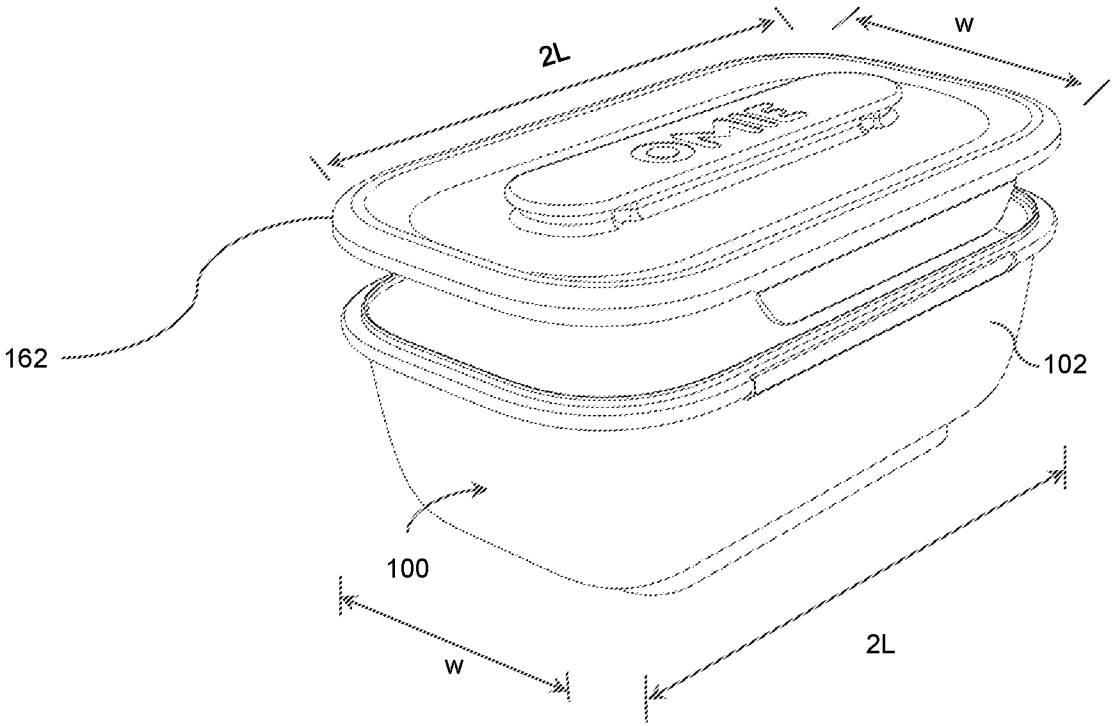
FIGS. 1A-1B provide open figurations of the large vessel, large vessel lid, small vessel, small vessel lid.
Figure 1B:
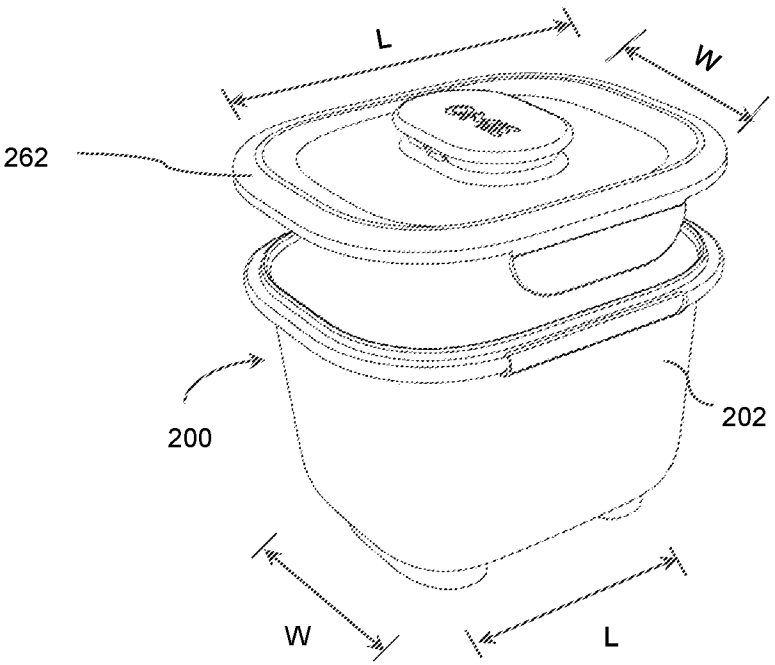

FIG. 1A-1B are views of two container and lid combinations 100 and 200. The combination 100 includes a container 102 for storing food, and a lid 162 covering the container. The combination 200 has a container 202 for storing food, and a lid 262 for covering the container. The containers 102 and 202 are depicted in the drawing as being a rectangular cuboid with sloped faces, an open top and round corners, however, they can be formed in different shapes, for example spherical.

The combinations 100 and 200 are modular in the sense that they can be stacked and locked to form compact, transportable combinations. This will be described in more detail below. While there are no limitations on the width, length, or height of containers 102, 202 and lids 162, 262, container 202 can be proportional to container 102 and lid 262 can be proportional to lid 162 so that the containers and lids can be stacked in compact combinations. For example, the container 202 can have a length of L and a width of W and the container 102 can have a length of 2 L and a width of W. In another example, container 202 can have a length of L and a width of W and the container 102 can have a length of 3 L and a width of L.

Our disclosure is not limited to the two containers and two lids disclosed in FIG. 1A-1B. Numerous other containers and lids with different dimensions, shapes, and volumes can be provided in a system of containers according to our disclosure.

Figure 2A:
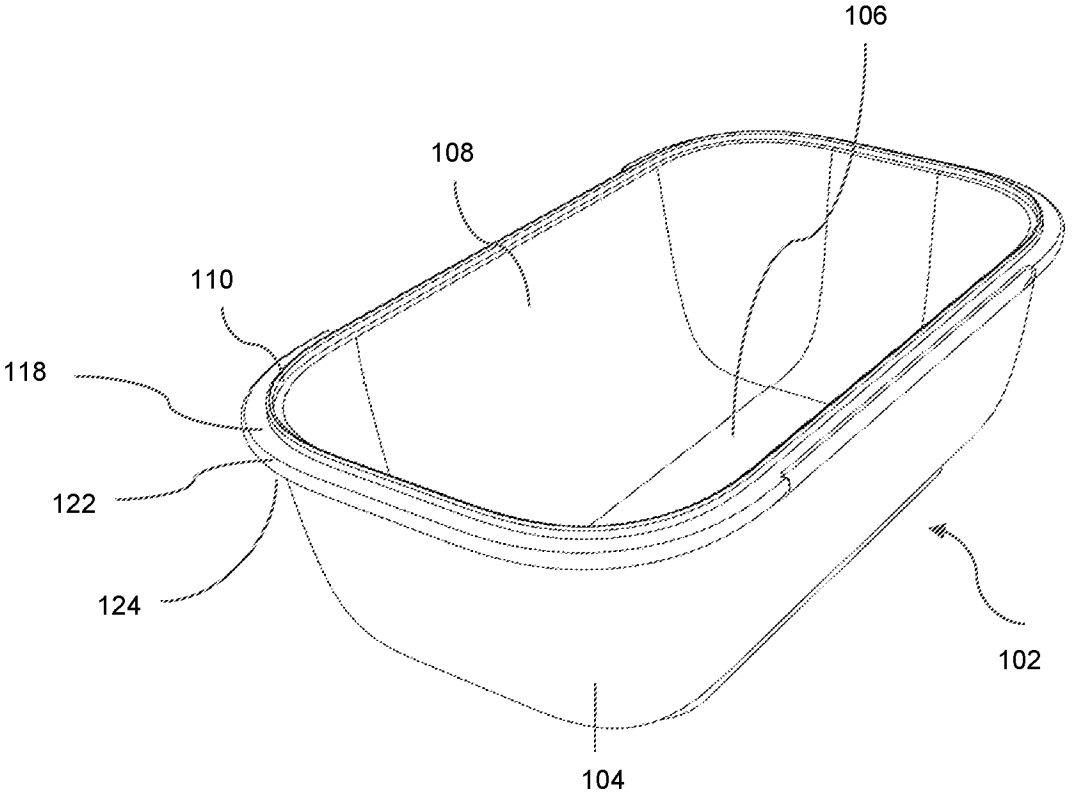
FIGS. 2A-2C provide aerial, side, bottom and side views of the large vessel.
Figure 2B:
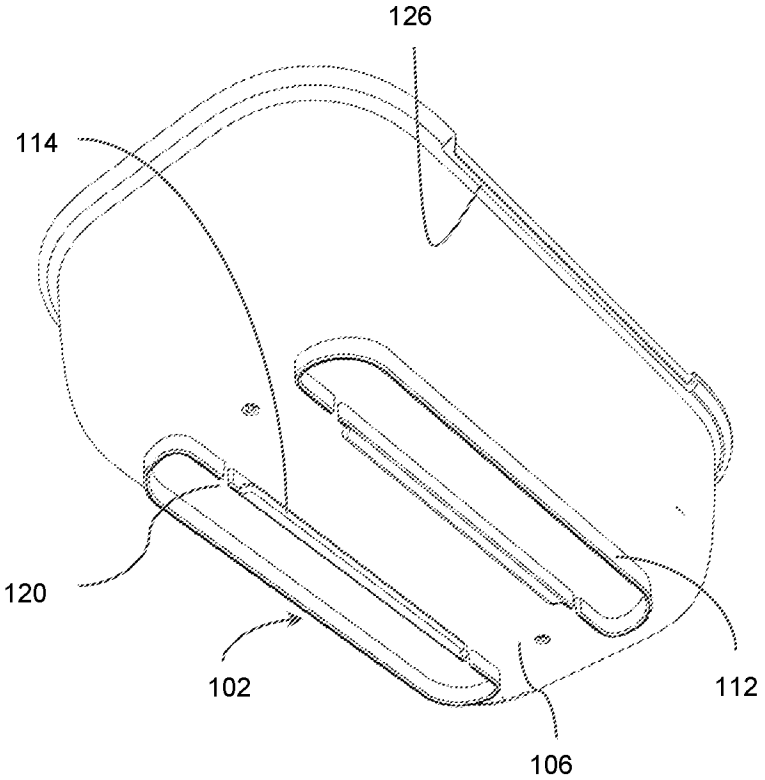
Figure 2C:
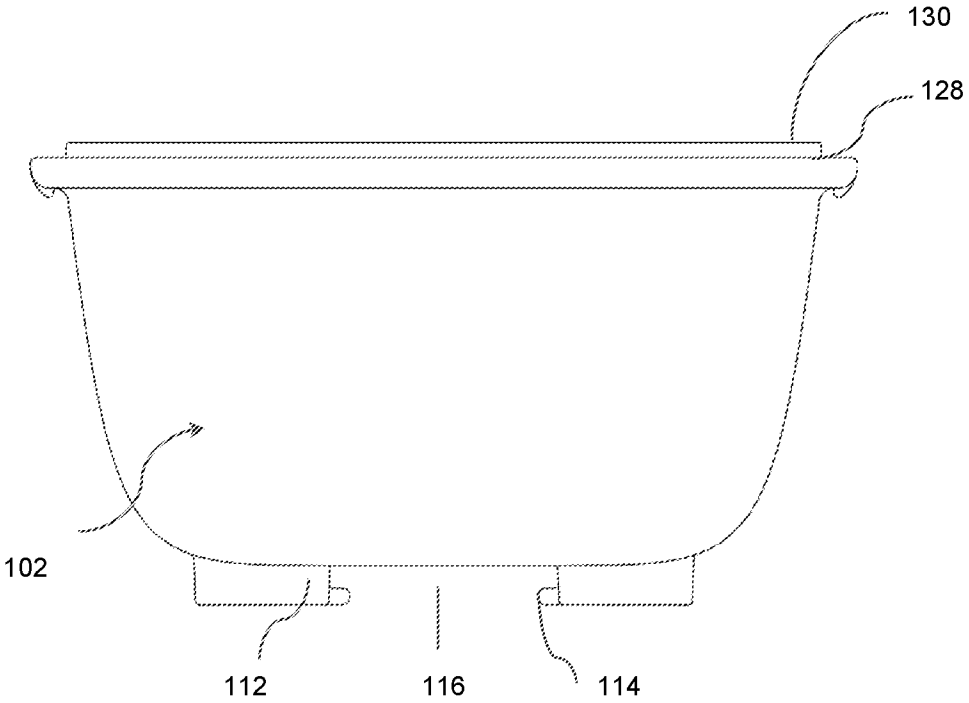
Figure 3A:
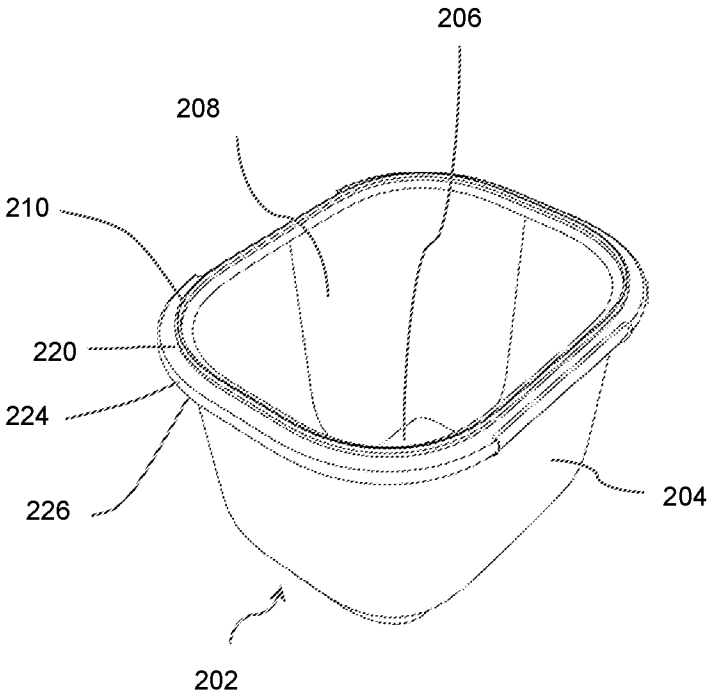
FIGS. 3A-3D provide aerial, bottom, and side views of the small vessel.
Figure 3B:
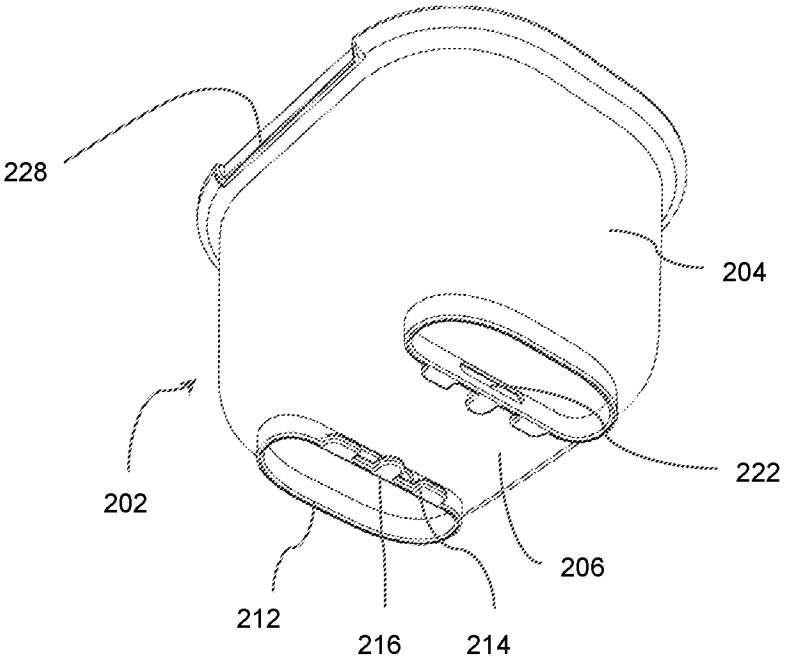
Figure 3C:
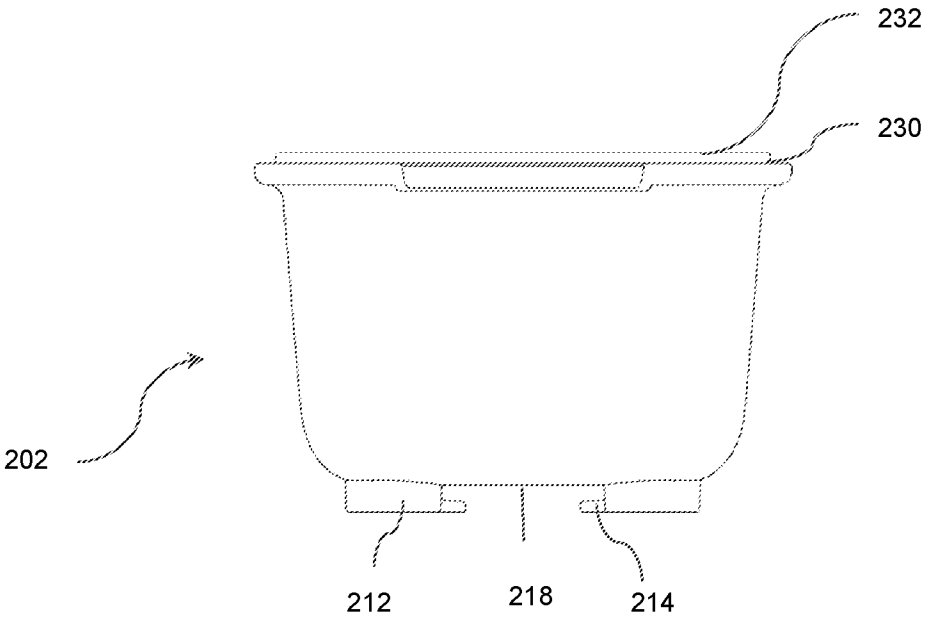
Figure 3D:
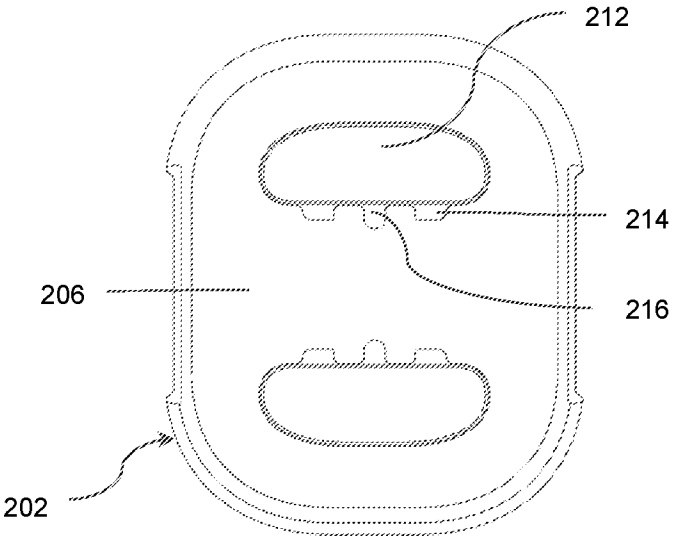

FIG. 2A-2C are views of container 102. Container 102 has a plurality of side walls 104 attached to the bottom wall 106 to define a partially-enclosed volume and open top 108. There is a flat planar rim 118 along the edge of the open top 108, with the distal edge of the rim 118 extending downward into a wall portion 122 with a lower edge 124. As will be appreciated by those skilled in the art, the container 102 is a single structure, fabricated by injection molding using a material such as polypropylene, acrylonitrile butadiene styrene, or polyethylene terephthalate.

In one embodiment, there is a raised sealing rib 110 on the inner perimeter of rim 118. There are no limitations to the profile, height, or width of sealing rib 110. For example, sealing rib 110 can have a rectangular prism profile, where the width of the base 128 is equivalent to the width of the edge 130. It can also have a triangular prism profile, where the width of the base 128 exceeds the width of the edge 130. The edge profile can be straight, or it can be rounded. When lid 162 with elastomeric sealing gasket 172 is latched on container 102, the sealing rib 110 compresses against the lid gasket 172 to form a water tight, air tight seal.

In another embodiment, there is no sealing rib 110 on rim 118. Rim 118 has a flat, planar surface which compresses against elastomeric sealing gasket 172 to form a water tight, air tight seal.

Latch hook 126 is provided as a means of engaging the latches to seal the container 102. The latches engage the underside of latch hook 126 to secure the lid 162 in a closed position. There are no limitations to the number, size, or placement of latch hooks 126.

On the outside surface of bottom wall 106 there is a plurality of extruded feet 112, for example in our disclosure, two feet. Feet 112 elevate container 102 above an eating surface, providing a stable, flat base to prevent container 102 from wobbling during usage. Hook 114 is an extrusion that juts out perpendicularly along the inner perimeter of feet 112. Hook 114 forms a groove 116 which can be mated with lid rail 164. This will be described in more detail below. Although feet 112 are depicted as being trapezoidal prisms, it can be formed in different shapes, for example, ovoid.

In one embodiment, water outlets 120 are placed to the left and right of the hook 114. The water outlets allow pooled water in feet 112, accumulated during cleaning, to flow out. There are no limitations to the shape, quantity or placement of water outlets 120. For example, in our drawing, we disclose four water outlets 120.

FIG. 3A-3D are views of container 202. Container 202 has a plurality of side walls 204 attached to the bottom wall 206 to define a partially-enclosed volume and open top 208. There is a flat planar rim 220 along the edge of the open top 208, with the distal edge of the rim 220 extending downward into a wall portion 224 with a lower edge 226. As will be appreciated by those skilled in the art, the container 202 is a single structure, fabricated by injection molding using a material such as polypropylene, acrylonitrile butadiene styrene, or polyethylene terephthalate.

In one embodiment, there is a raised sealing rib 210 on the inner perimeter of rim 220. There are no limitations to the profile, height or width of sealing rib 210. For example, sealing rib 210 can have a rectangular prism profile, where the width of the base 230 is equivalent to the width of the edge 232. It can also have a triangular prism profile, where the width of the base 230 exceeds the width of the edge 232. The edge 232 profile can be straight, or it can be rounded. When lid 262 with elastomeric sealing gasket 272 is latched on container 202, the sealing rib 210 compresses against the lid gasket 272 to form a water tight, air tight seal In another embodiment, there is no sealing rib 210 on rim 220. Rim 220 has a flat, planar surface which compresses against elastomeric sealing gasket 272 to form a water tight, air tight seal.

Latch hook 228 is provided as a means of engaging the latches to seal the container 202. Latches engage the underside of latch hook 228 to secure the lid 262 in a closed position. There are no limitations to the number, size, or placement of latch hooks 228.

On the outside surface of bottom wall 206 there is a plurality of extruded feet 212, for example in our disclosure, two feet. Feet 212 elevate container 202 above an eating surface, providing a stable, flat base to prevent container 202 from wobbling during usage. Hook 214 is an extrusion that juts out perpendicularly along the inner perimeter of feet 212. Hook 214 forms a groove 218 which can be mated with lid rail 164 and 264. Tab 216 is an extrusion that juts out perpendicularly from the center of feet 212. Tab 216 can flex and engage with notch 166 and notch 266 to lock container 202 into position on rail 164 and rail 264. This will be described in detail later. Although we disclose feet 212 as being ovoid in shape, it can be formed in different shapes, for example rectangular prism.

In one embodiment, there is a water outlet 222 along the inner edge of feet 212. The water outlet allows pooled water in feet 212, accumulated during cleaning, to flow out. There are no limitations to the shape, quantity, placement or size of water outlets 222. For example, in our drawing, we disclose two water outlets 222.

Figure 4A:
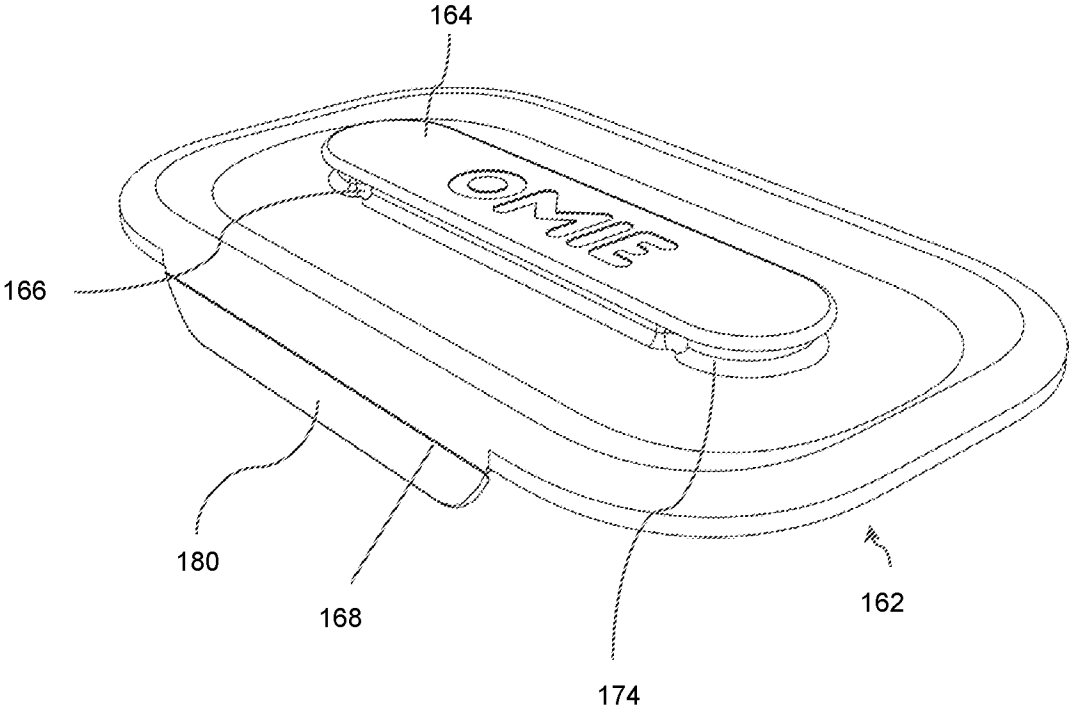
FIGS. 4A-4B provide interior and exterior views of the large vessel lid.

FIG. 4A is a view of the outside surface of lid 162. Rail 164 is an extruded shape on the outside surface of lid 162 located in the center of the lid and running parallel to the edge. The rail 164 has a shape which is complementary to groove 116 on container 102, as well as groove 218 on container 202. This will be described in more detail below. Although rail 164 is depicted as being ovoid in shape, it can be formed in different shapes, such as a rectangular prism, as long as the shape is complementary to grooves 116 and 218.

There is an undercut on rail 164 which creates a rail base 174. Rail base 174 has the same shape as rail 164, but it is shorter and narrower in dimension. Rail base has a plurality of notches 166 cut into both sides of the rail. The purpose of the notches 166 is to lock containers 202 into position on the rail 164. When a user slides feet 212 over rail 164, tab 216 will flex and slide into notch 166. Notch 166 holds tab 216 securely, thereby locking container 202 into position on rail 164. To disengage, users must apply extra sliding force to disengage tab 216 from notch 166.

The latches 180 are connected to the lid periphery by living hinges 168 so that the latches may be rotated about the hinges 168 to the downwardly positioned latch position, and upwardly positioned latch release position. As will be appreciated by those skilled in the art, the lid is a single structure, fabricated by injection molding using a material such as polypropylene.

Figure 4B:
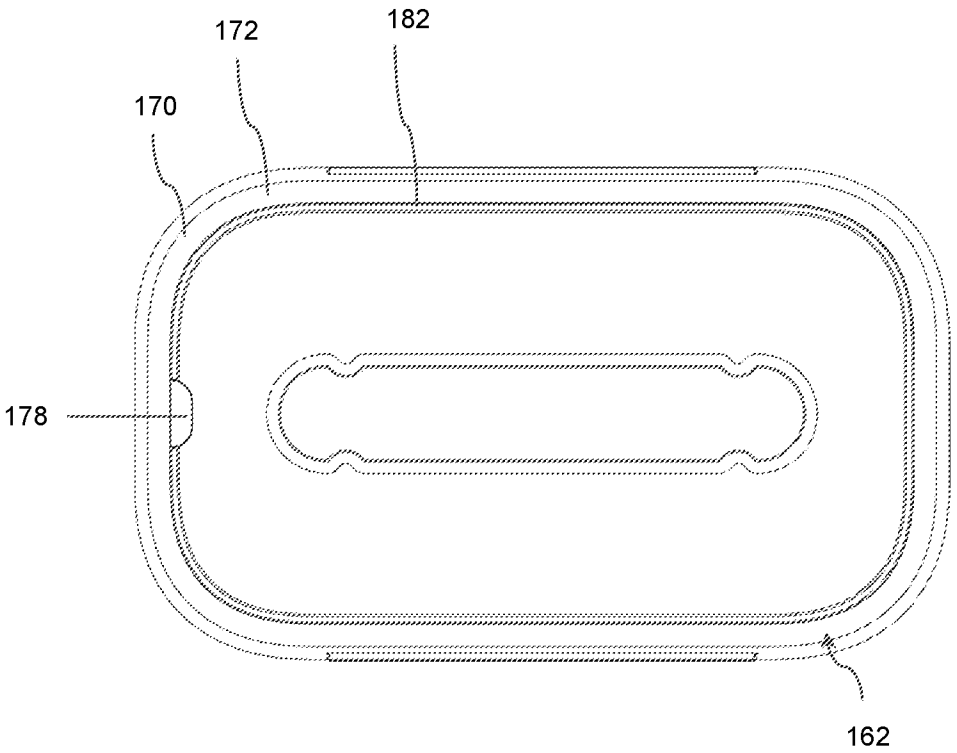

FIG. 4B is a view of the inside surface of lid 162. Slot 170 is a recessed groove around the inside perimeter of lid 162 that can house an elastomeric sealing gasket 172. Gasket 172 can be made from a soft, compressible material such as silicon or TPE, so that when compressed, it forms a water tight, air tight seal.

Inner rib 182 protrudes downwardly from the inner surface of lid 162 and has dimensions that are proportional to the perimeter of the top edge of container 102. The purpose of inner rib 182 is to align the lid 162 with the container 102 while the lid 162 is being installed on the container 102. To make gasket 172 easily removable for cleaning, inner rib 182 has a cut out 178 which allows the user to hook the gasket and lift it out of the slot 170. There are no limitations to the size, placement, or number of cut out 178.

Figure 5A:
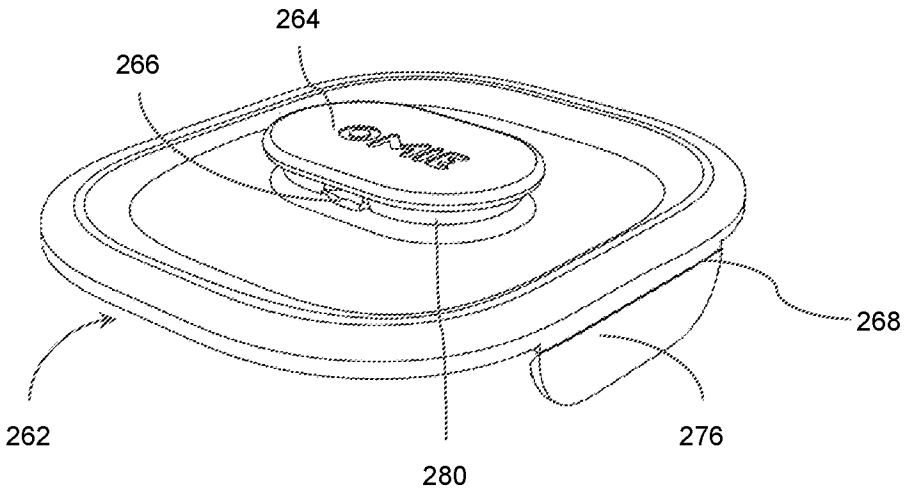
FIGS. 5A-5B provide interior and exterior views of the small vessel lid.

FIG. 5A is a view of the outside surface of lid 262. Rail 264 is an extruded shape on the outside surface of lid 262. The rail 264 has a shape which is complementary to groove 218 on container 202. This will be described in more detail below. Although rail 264 is depicted as being ovoid in shape, it can be formed in different shapes, such as a rectangular prism, as long as the shape is complementary to grooves 218.

There is an undercut on rail 264 which creates a rail base 280. Rail base 280 has the same shape as rail 264, but it is shorter and narrower in dimension. Rail base has notches 266 cut into both sides of the rail 264. The purpose of the notches 266 is to lock container 202 into position on the rail. When a user slides feet 212 over rail 264, tab 216 will flex and slide into notch 266. Notch 266 holds tab 216 securely, thereby locking container 202 into position on rail 264. To disengage, users must apply extra sliding force to disengage tab 216 from notch 266.

The latches 276 are connected to the lid periphery by living hinges 268 so that the latches may be rotated about the hinges 268 to the downwardly positioned latch position, and upwardly positioned latch release position. As will be appreciated by those skilled in the art, the lid is a single structure, fabricated by injection molding using a material such as polypropylene.

Figure 5B:
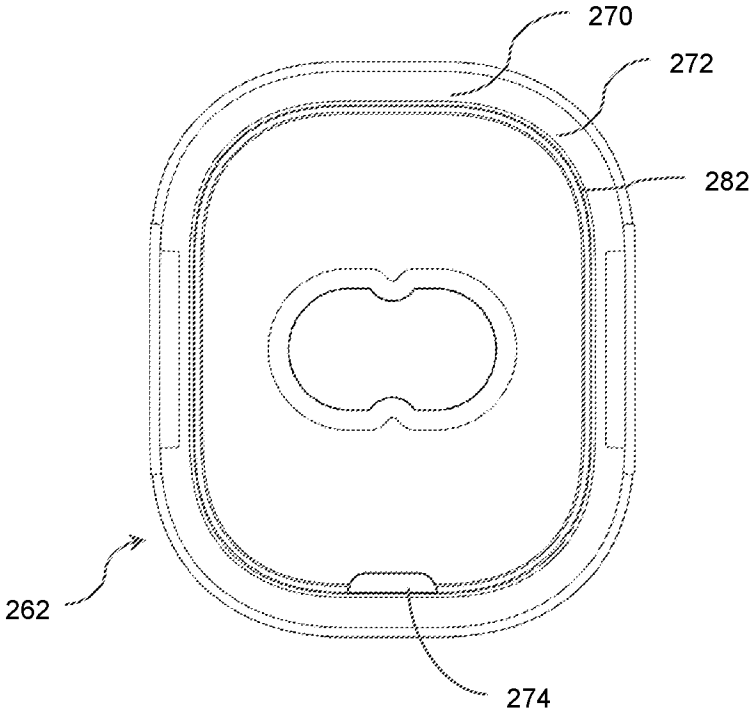

FIG. 5B is a view of the inside surface of lid 262. Slot 270 is a recessed groove around the inside perimeter of lid 262 that can house an elastomeric sealing gasket 272. Gasket 272 can be made from a soft, compressible material such as silicon or TPE, so that when compressed, it forms a water tight, air tight seal.

Inner rib 282 protrudes downwardly from the inner surface of lid 262 and has dimensions that are proportional to the perimeter of the top edge of container 202. The purpose of inner rib 282 is to align the lid 262 with the container 202 as the lid 262 is being installed on the container 202. In order to make gasket 272 easily removable for cleaning, inner rib 282 has a cut out 274 which allows the user to hook the gasket and lift it out of the slot 270. There are no limitations to the size, placement, or number of cut out 274.

Figure 6A:
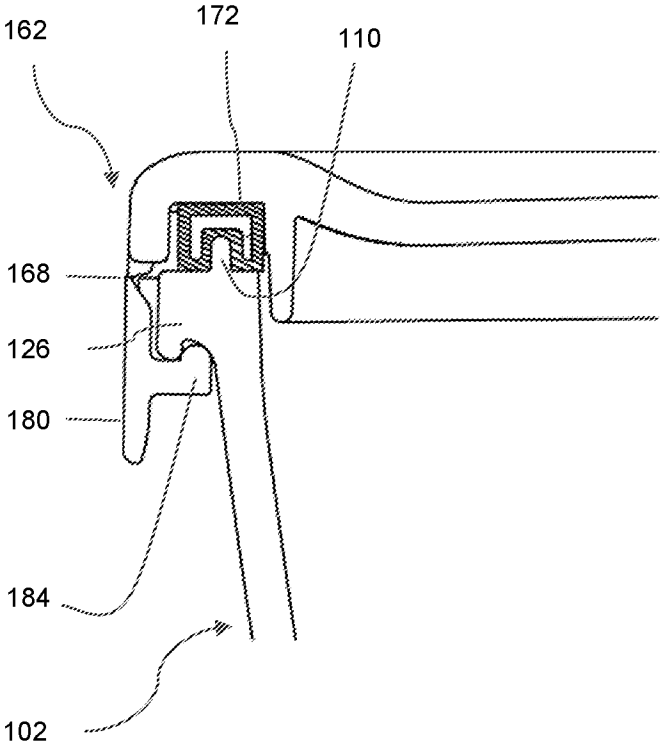
FIGS. 6A-6B provide cross sectional views of the sealing mechanism for the small vessel and large vessel.

FIG. 6A is a cross section view of the sealing mechanism for combination 100. Latch 180 has a barb 184 which engages latch hook 126 in a latch position. The latch position compresses sealing rib 110 against gasket 172 to form a water tight, air tight seal.

Figure 6B:
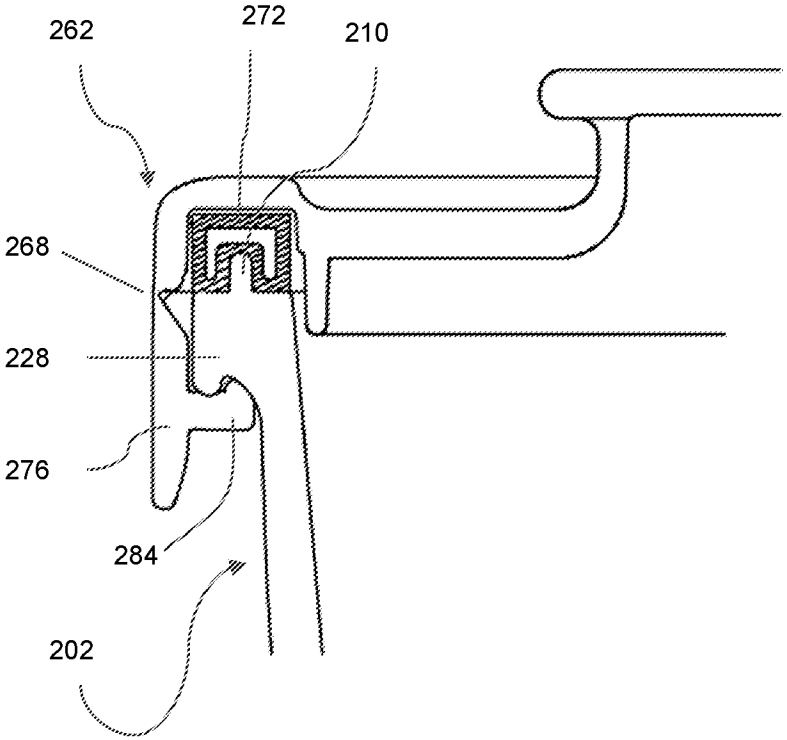

FIG. 6B is a cross section view of the sealing mechanism for combination 200. Latch 276 has a barb 284 which engages latch hook 228 in a latch position. The latch position compresses sealing rib 210 against gasket 272 to form a water tight, air tight seal.

Figure 7A:
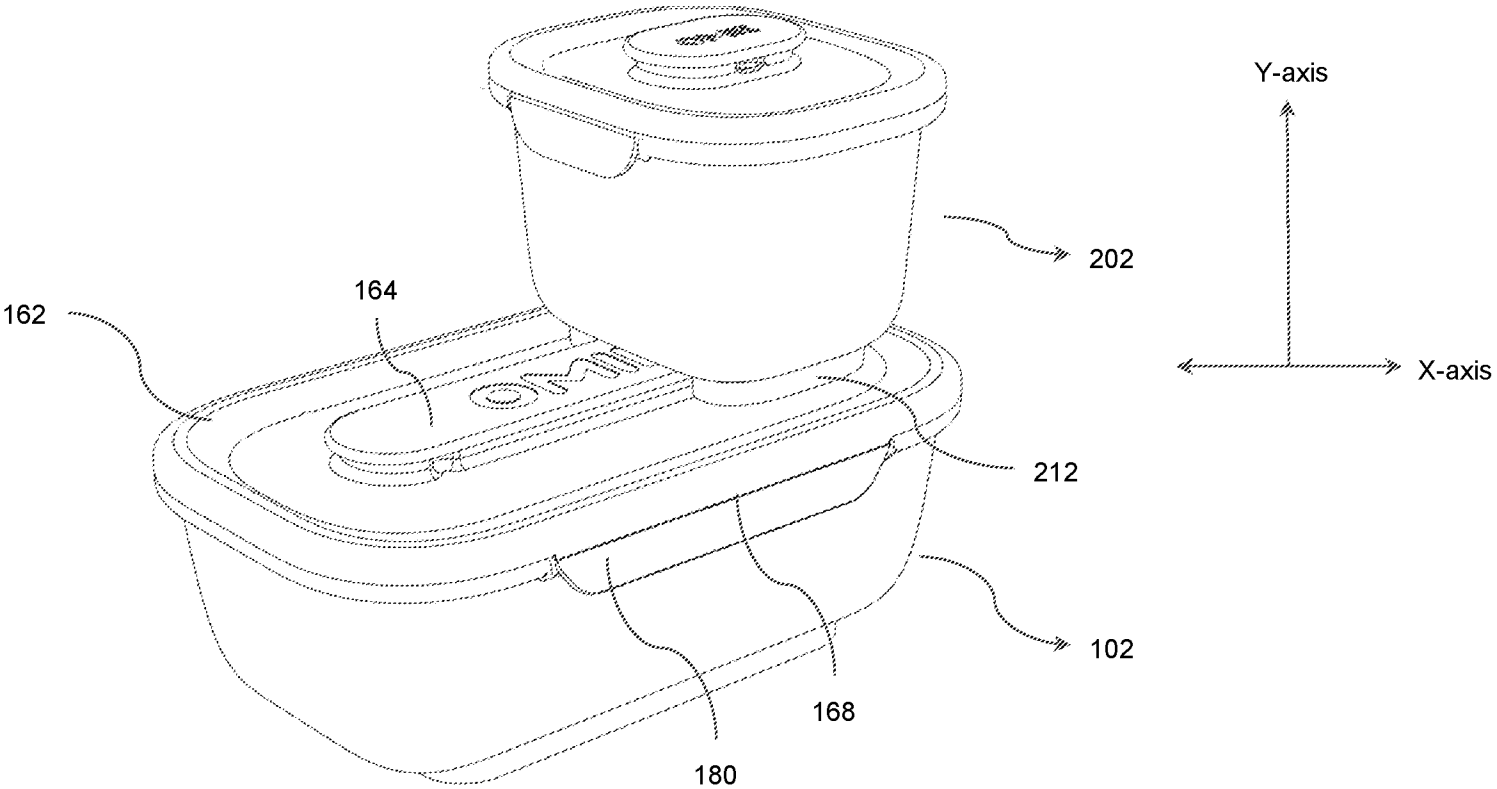
FIGS. 7A-7C provide frontal and side views of the small vessel stacked atop the large vessel.
Figure 7B:
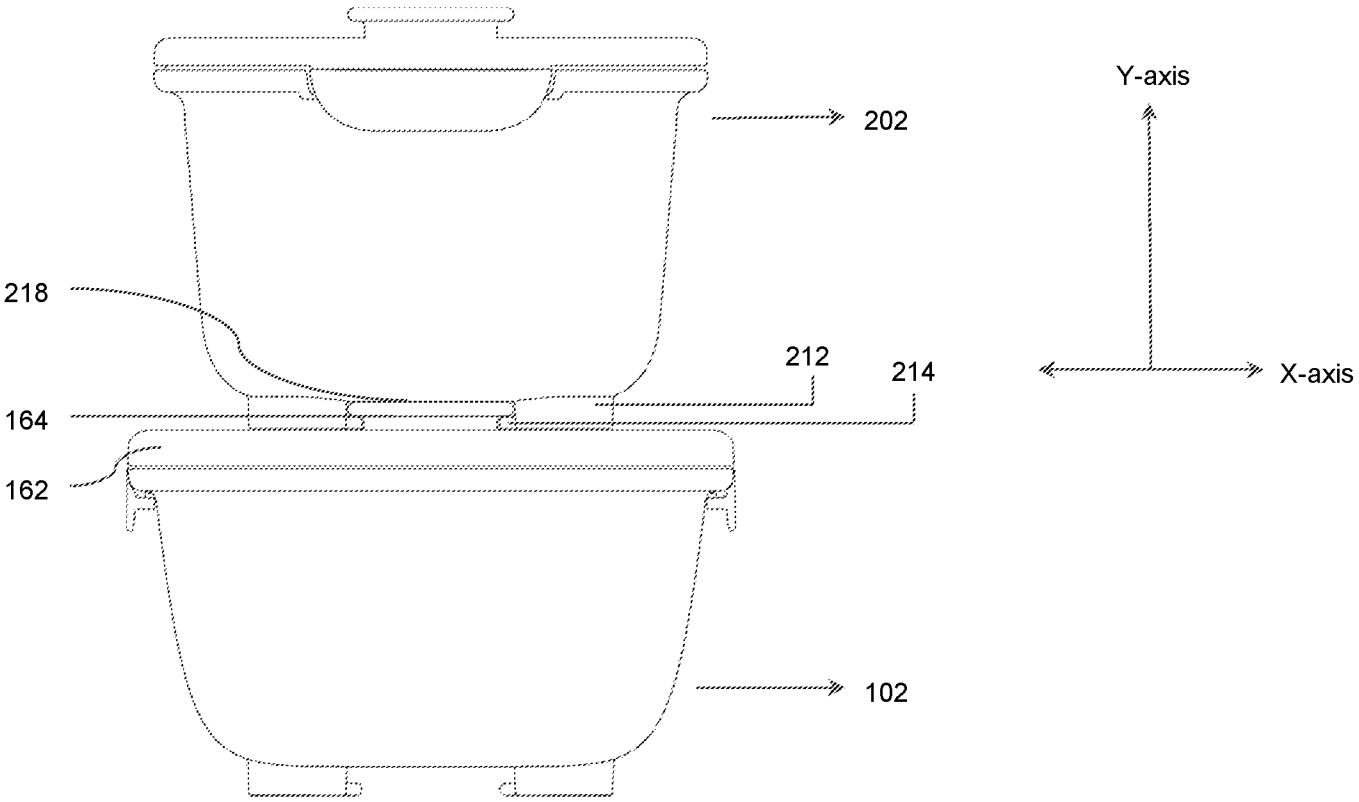

FIG. 7A-7B are views of the stacked and interlocked containers. Lid 162 is covering container 102 with latches 180 rotated about the living hinges 168 to the downwardly positioned latch position. Container 202 is stacked and locked on top of container 102. It does so by sliding feet 212 over rail 164, with feet 212 forming a groove 218 that is complementary to rail 164 such that it can engage along the X-axis. Hook 214 engages the portion of the rail immediately above the undercut, thereby suspending the rail 164 between hook 214 and the exterior of the bottom wall 106. This design prevents feet 212 from being pulled away from rail 164 on the Y-axis.

Figure 7C:
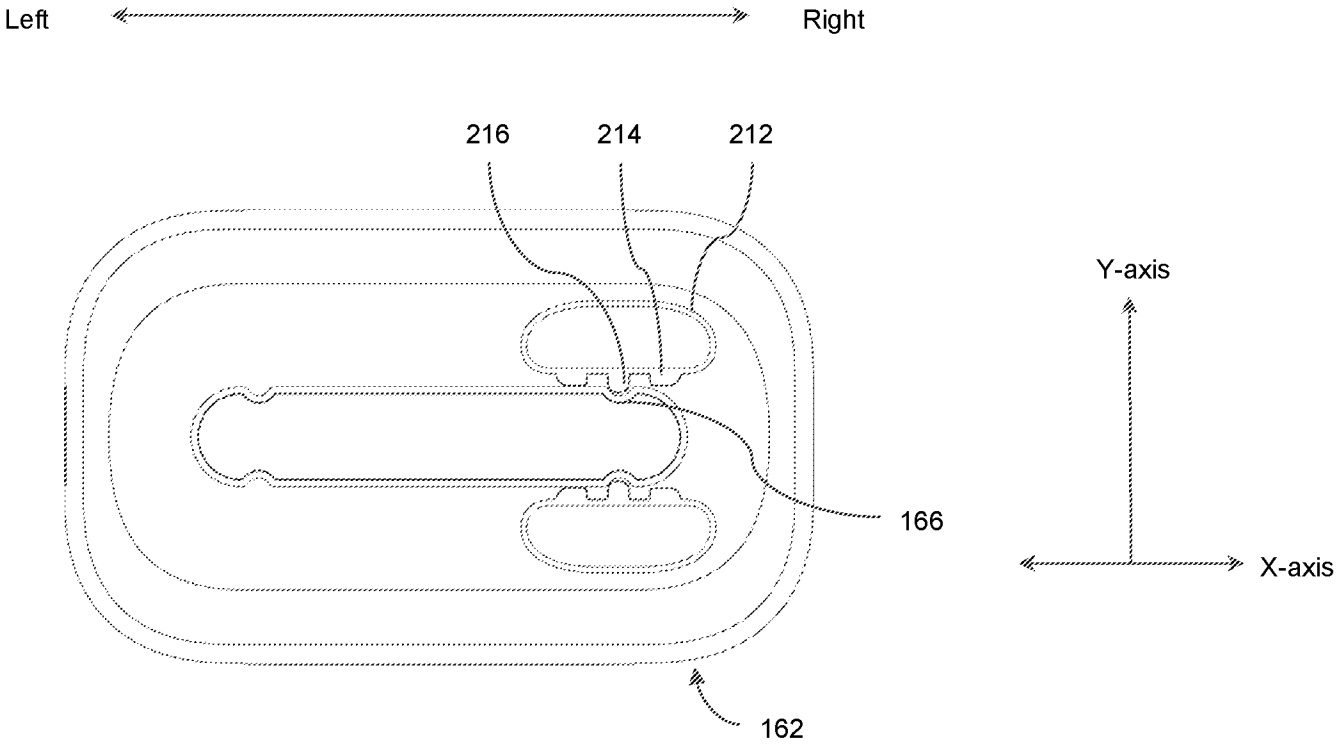

FIG. 7C is a cross sectional view of the stacked and interlocked combinations 100 and 200. Feet 212 can slide over rail 164 from either left or right directions. When sliding, rail 164 will interfere with tab 216, therefore requiring the user to exert additional sliding force which causes tab 216 to flex and engage with notch 166. This engagement locks combination 200 into a half section of lid 162 and prevents combination 200 from disengaging from the rail in either the X-axis or Y-axis.

Figure 8A:
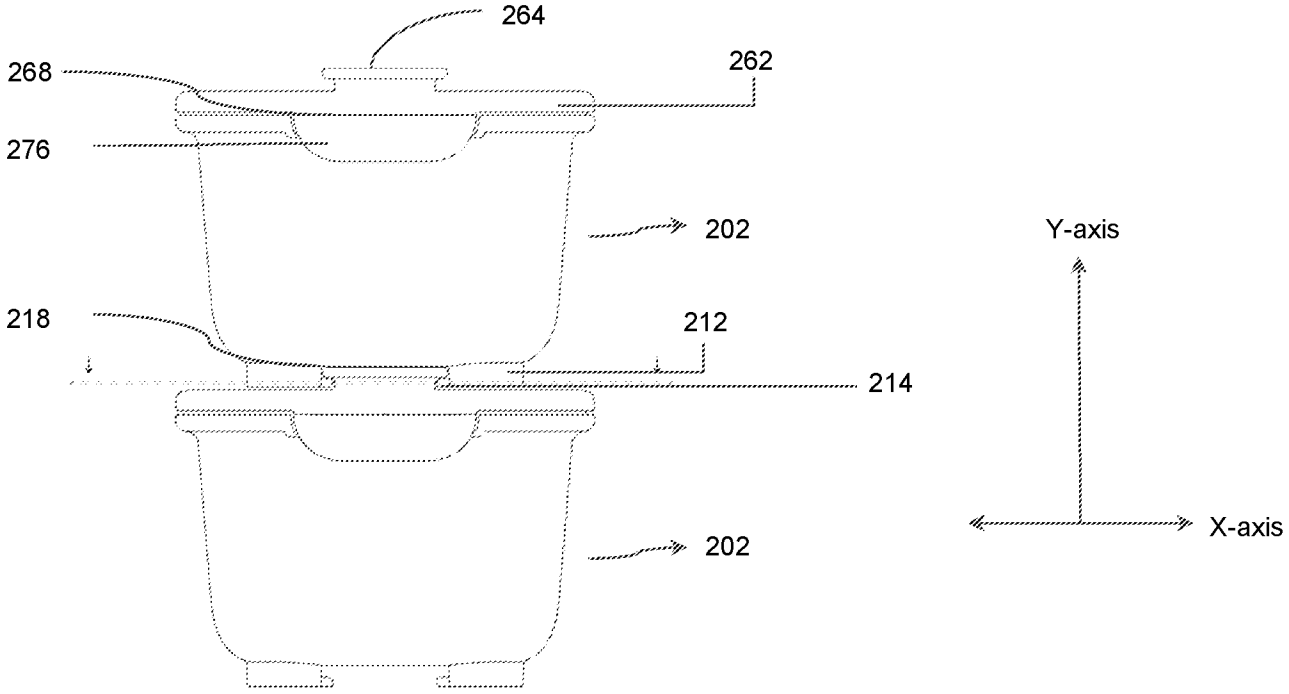
FIGS. 8A-8B provide frontal and cross section views of two small vessels stacked atop each other.

FIG. 8A is a view of the stacked and interlocked containers 202. Lid 262 is covering container 202 with latches 276 rotated about the living hinges 268 to the downwardly positioned latch position. Container 202 is stacked and locked on top of container 202. It does so by sliding feet 212 over rail 264, feet 212 forming a groove 218 that is complementary to rail 264 such that it can engage along the X-axis. Hook 214 engages the portion of the rail immediately above the undercut, thereby suspending the rail 264 between hook 214 and the exterior of the bottom wall 206. This design prevents feet 212 from being pulled away from rail 264 on the Y-axis.

Figure 8B:
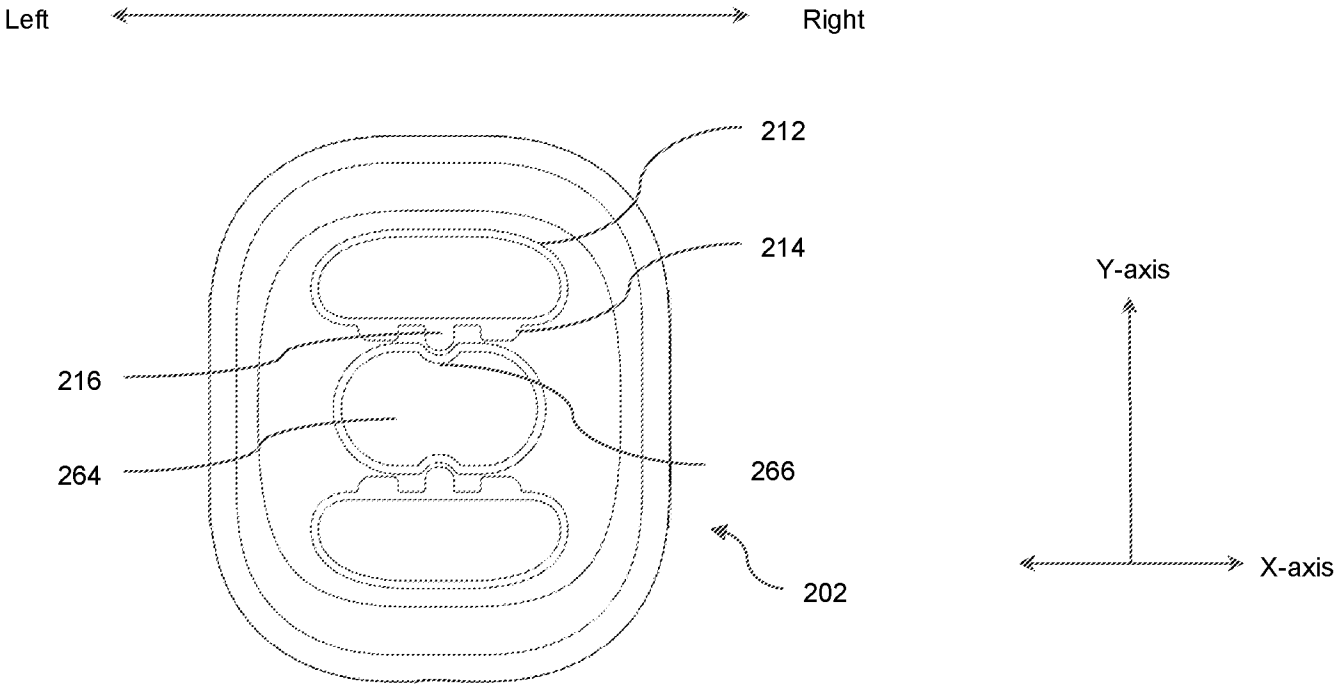
Figure 9A:
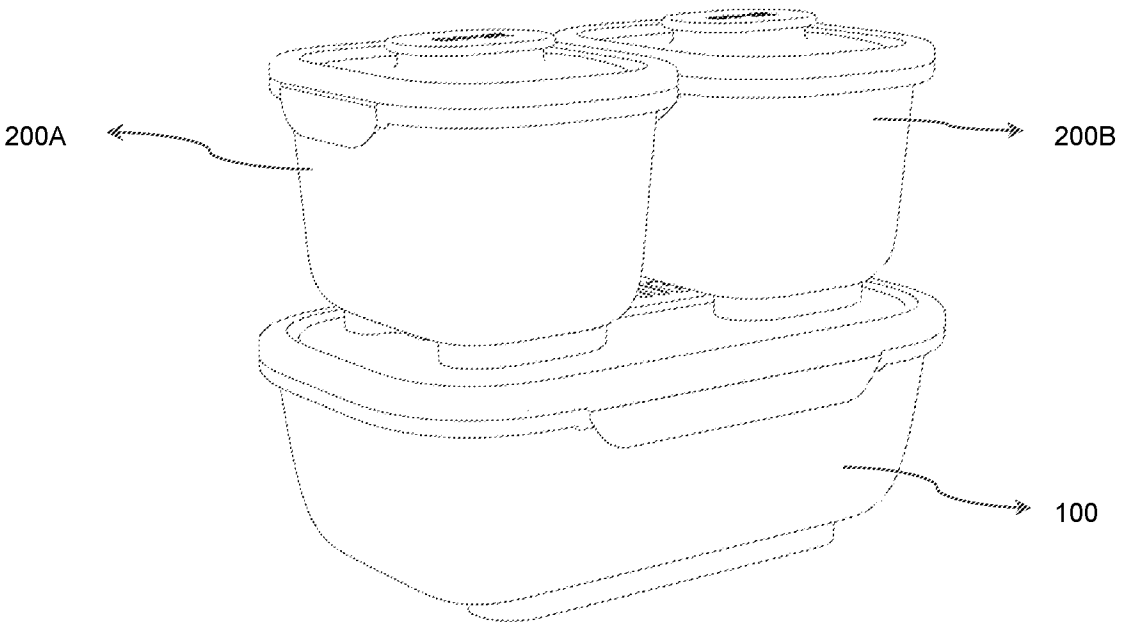
FIGS. 9A-9D provide views of various stacking combinations.
Figure 9B:
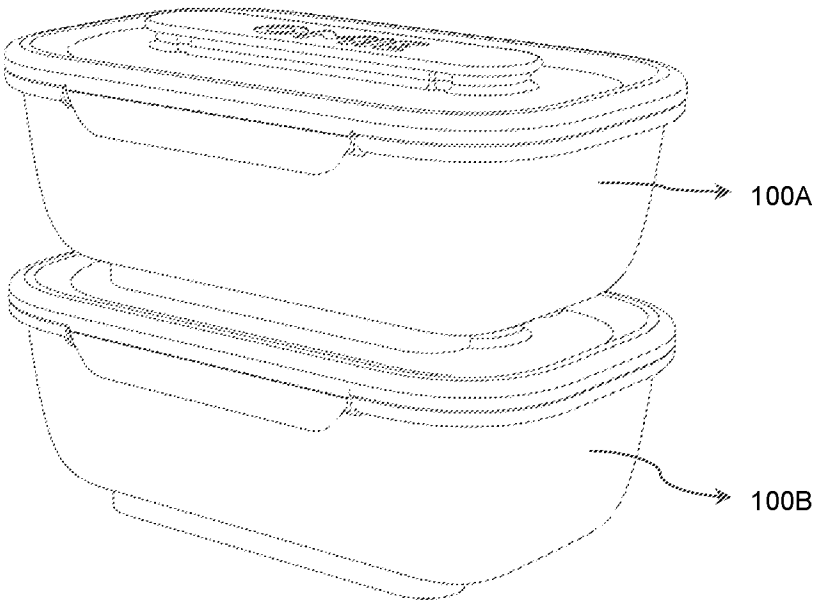
Figure 9C:
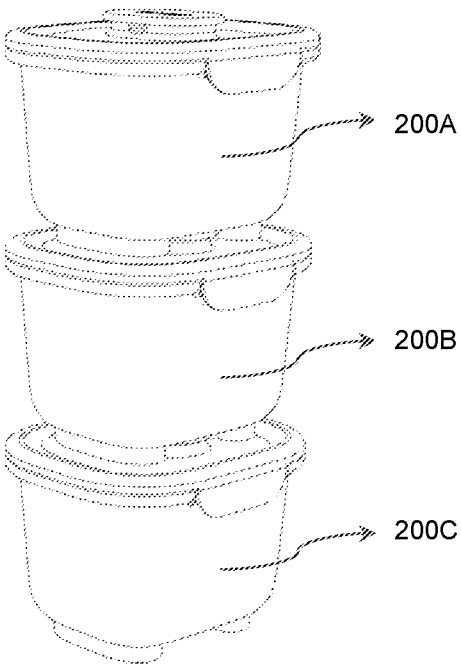
Figure 9D:
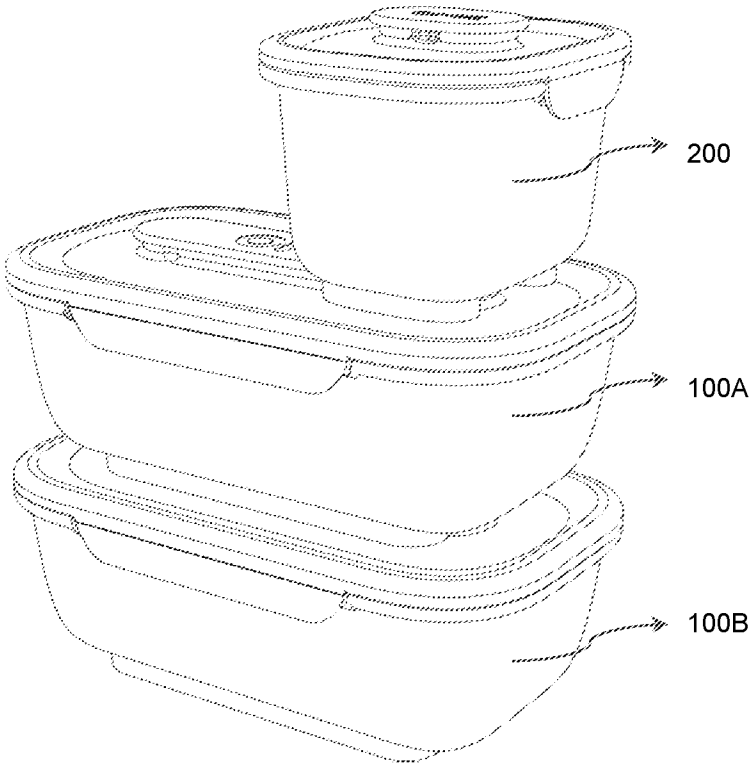

FIG. 8B is a cross sectional view of the stacked and interlocked combinations 200. Feet 212 can slide over rail 264 from either left or right directions. When sliding, rail 264 will interfere with tab 216, therefore requiring the user to exert additional sliding force which causes tab 216 to flex and engage with notch 266. This engagement locks combination 200 onto lid 262, and prevents combination 200 from disengaging from the rail in either the X-axis or Y-axis.

FIG. 9A-9D illustrates the various ways combinations 100 and 200 can stacked and interlocked in modular combinations. The present application is not limited to the modular combinations disclosed in FIG. 9A-9D. Numerous other modular combinations can be provided in a system of containers according to various implementations.

Figure 10A:
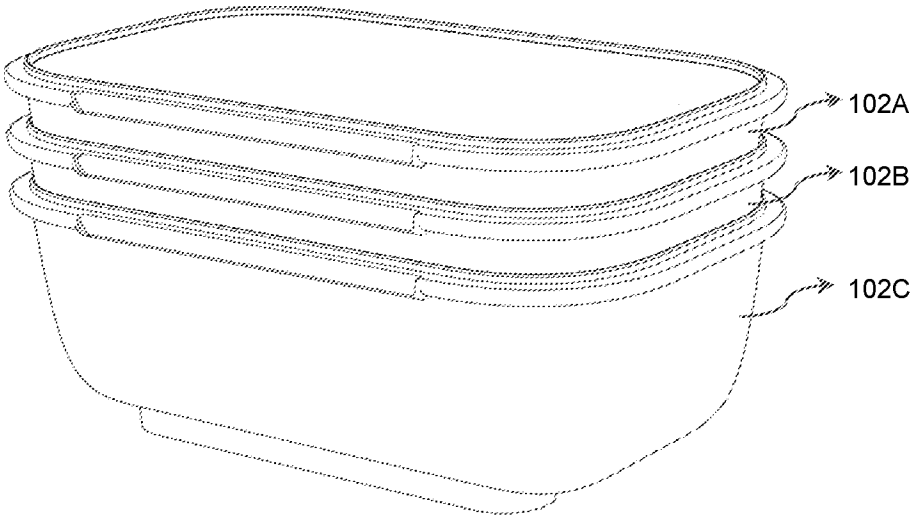
FIGS. 10A-B provide a frontal view of the large vessel stacked, small vessel stacked.
Figure 10B:
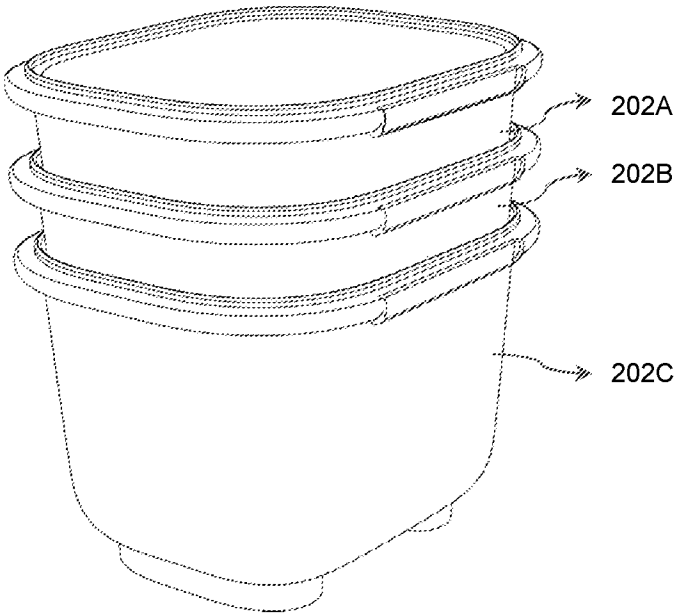

FIG. 10A-10B illustrate how the containers 102A, 102B, 102C and 202A, 202B, 202C can be nested into each other to save space when stored. Containers 102 and 202 have a tapered profile which facilitates the stacking.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A container system comprising:

a large container having an open large container top and a resealable large container lid defining a periphery that removably engages the large container top;

a plurality of smaller containers each respectively having an open small container top and a resealable small container lid that removably engages the small container top;

an elongated rail formed lengthwise along a horizontal axis on the large container lid with a plurality of notches, the rail defining an ovoid with edges remote from the periphery; and a pair of feet formed on each of the small containers, the feet defining opposing inner hooks that slidably mate along the horizontal axis with two edges of the rail opposite to each other across the horizontal axis, the opposing inner hooks disposed along an inner edge of each of the pair of feet and including at least one tab that elastically engages one of the plurality of notches so that the plurality of smaller containers are removably secured to the large container lid.

2. The container system as set forth in claim 1 wherein the large container has a bottom wall, a plurality of side walls attached to the bottom wall to form a volume beneath the open large container top, wherein the bottom wall has an outside surface and an inside surface, and the resealable large container lid further includes an outside surface and an inside surface, in which the outside surface of the resealable large container lid extends above an outer edge of the resealable large container lid.

3. The container system as set forth in claim 2, further comprising a another large container having a bottom wall, a plurality of side walls attached to the bottom wall to form a volume beneath an open other large container top, wherein the bottom wall has an outside surface and an inside surface, in which the outside surface of the other large container includes a pair of feet formed on the bottom wall of the other large container, the feet defining opposing inner hooks that slidably mate along the horizontal axis with the two edges of the rail of the large container lid.

4. The container system as set forth in claim 3, wherein the hooks of the feet of the other large container include at least one tab that elastically engages one of the notches so that the other large container is removably secured to the large container top.

5. The container system as set forth in claim 3, wherein each of the pair of the feet of the other large container are formed as an extrusion in a polymer material.

6. The container system as set forth in claim 3 wherein the other large container includes a resealable other large container lid defining a periphery that removably engages the open other large container top, and a rail formed on the other large container lid.

7. The container system as set forth in claim 6 wherein the rail formed on the other large container lid includes a plurality of notches, and the rail defining an ovoid with edges remote from the periphery of the other large container lid.

8. The container system as set forth in claim 1 wherein each of the pair of feet are formed as an extrusion in a polymer material.

9. The container system as set forth in claim 8, wherein the large container defines a shape along the side walls that tapers inwardly from the open large container top to the bottom.

10. The container system as set forth in claim 8, wherein the large container resealable lid includes opposing latches that removably engage a lip on the open large container top and rotate using a living hinge.

11. The container system as set forth in claim 10, wherein the inside surface of the lid includes a perimeter seal that engages the lip of the open large container top.

12. The container system as set forth in claim 1, wherein the small container resealable lid includes opposing latches that removably engage a lip on the open small container top, the opposing latches each rotating using a living hinge.

13. The container system as set forth in claim 1, wherein the small container resealable lid includes a perimeter seal that engages a lip of the open small container top.

14. The container system as set forth in claim 1, wherein the large container resealable lid includes opposing latches that removably engage a lip on the open large container top, the opposing latches each rotating using a living hinge.

15. The container system as set forth in claim 1, wherein the large container resealable lid includes a perimeter seal that engages a lip of the open large container top.

16. The container system as set forth in claim 1, wherein at least one of the small containers has a bottom wall, a plurality of side walls attached to the bottom wall to form a volume beneath the open small container top, wherein the bottom wall has an outside surface and an inside surface and the resealable small container lid further includes an outside surface and an inside surface, in which the outside surface of the resealable small container lid extends above an outer edge of the resealable small container lid.

17. A container system comprising:

a first container having an open first container top and a resealable first container lid defining a periphery that removably engages the first container top;

a second container having an open second container top and a resealable second container lid that removably engages the second container top;

an elongated rail formed lengthwise along a horizontal axis on an outer surface of the first container lid, the rail defining edges remote from the periphery, two of the edges defined on opposite sides of the horizontal axis, the elongated rail including at least one notch defined on at least one of the two of the edges; and a pair of feet formed on the second container, the feet defining opposing inner hooks that slidably mate along the horizontal axis with the two of the edges of the rail, the opposing inner hooks disposed along an inner edge of each of the pair of feet and including at least one tab that elastically engages the at least one notch so that the second container is removably secured along the horizontal axis to the first container lid.

18. The container system as set forth in claim 17 wherein the at least one notch is defined on each of the two of the edges.

19. The container system as set forth in claim 17 wherein each of the pair of feet are formed as an extrusion in a polymer material.

20. The container system as set forth in claim 19, wherein the first container resealable lid includes opposing latches that removably engage a lip on the open first container top and rotate using a living hinge.

* * * * *